US007118649B2

(12) United States Patent
Morohoshi et al.

(10) Patent No.: US 7,118,649 B2
(45) Date of Patent: Oct. 10, 2006

(54) DEVICE AND METHOD FOR MANUFACTURING SPEAKER DIAPHRAGM, THE DIAPHRAGM, AND SPEAKER

(75) Inventors: Yukinori Morohoshi, Mie (JP); Shinya Mizone, Mie (JP); Nobuo Nakamura, Mie (JP); Kazuto Nakamura, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 289 days.

(21) Appl. No.: 10/471,014

(22) PCT Filed: Jan. 30, 2003

(86) PCT No.: PCT/JP03/00880

§ 371 (c)(1),
(2), (4) Date: Sep. 8, 2003

(87) PCT Pub. No.: WO03/065765

PCT Pub. Date: Aug. 7, 2003

(65) Prior Publication Data

US 2004/0079505 A1 Apr. 29, 2004

(30) Foreign Application Priority Data

Feb. 1, 2002 (JP) ..... 2002-25134

(51) Int. Cl.
*D21J 3/12* (2006.01)
*H04R 31/00* (2006.01)

(52) U.S. Cl. ..... 162/228; 162/218; 162/226; 162/382; 162/387; 181/169; 249/141

(58) Field of Classification Search ..... 162/218–224, 162/226–229, 382–411; 181/165, 169; 264/86, 264/87; 249/141
See application file for complete search history.

(56) References Cited

U.S. PATENT DOCUMENTS

| | | | | | |
|---|---|---|---|---|---|
| 1,984,019 | A | * | 12/1934 | Hawley | 181/165 |
| 2,460,129 | A | * | 1/1949 | Ista | 162/409 |
| 2,624,417 | A | * | 1/1953 | Brennan | 181/169 |
| 2,705,442 | A | * | 4/1955 | Kyle et al. | 162/262 |
| 4,323,426 | A | * | 4/1982 | Cowan et al. | 162/398 |
| 5,817,216 | A | * | 10/1998 | Tomita et al. | 162/389 |

FOREIGN PATENT DOCUMENTS

| | | |
|---|---|---|
| JP | 55-124396 | 9/1980 |
| JP | 58-133096 | 8/1983 |
| JP | 61-177100 | 8/1986 |
| JP | 5-22791 | 1/1993 |

* cited by examiner

*Primary Examiner*—Eric Hug
(74) *Attorney, Agent, or Firm*—Wenderoth, Lind & Ponack, L.L.P.

(57) ABSTRACT

A loudspeaker diaphragm manufacturing apparatus of the present invention comprises; a paper tank, a pulp dispersion reservoir tank connected to the paper tank, a stirring means provided in the paper tank, a water inlet unit connected to the paper tank, a drain unit disposed under the paper tank, and a paper mold disposed at the bottom of the paper tank or in the drain unit, wherein a sectional area of the drain unit is larger than the plane area of the paper mold. The drain unit may be further provided with a water flow control plate in a draining direction of the paper mold. According to the manufacturing apparatus and the manufacturing method of the present invention, diaphragms with very uniform internal composition and diaphragms with intentionally varied internal composition in accordance with required sound characteristics can be mass-produced with good reproducibility.

27 Claims, 5 Drawing Sheets

DEVICE AND METHOD FOR MANUFACTURING SPEAKER DIAPHRAGM, THE DIAPHRAGM, AND SPEAKER

TECHNICAL FIELD

The present invention relates to a method of manufacturing a diaphragm for a loudspeaker used in various video and audio equipment, a manufacturing apparatus, and the diaphragm manufactured by the method, and a loudspeaker using the diaphragm.

BACKGROUND ART

A technique of manufacturing a conventional loudspeaker diaphragm will be described with reference to a sectional view of the loudspeaker in FIG. 6 and a schematic view of a paper forming machine in FIG. 7.

The loudspeaker shown in FIG. 6 comprises magnetic circuit 1 comprising lower plate 1*a* with a center pole, magnet 1*b*, upper plate 1*c*, and magnetic gap 1*d*; frame 2; conical diaphragm 3 with its outer periphery bonded to the frame 2 via edge 3*a* and its inner periphery bonded to voice coil 4; and damper 5.

As the diaphragm 3, a plastic or metal-sheet diaphragm is available, but a paper sheet is generally employed as a loudspeaker diaphragm. Paper is excellent in physical properties such as large internal loss and rigidity that are basically required for a loudspeaker diaphragm, and also, it has various features such as being inexpensive and being amenable to manufacture by blending various kinds of pulp to obtain characteristics appropriate for each application.

A manufacturing method for the diaphragm made of a paper sheet will be described with reference to FIG. 7.

In FIG. 7, the diaphragm manufacturing apparatus comprises paper tank 11 for feeding dispersed pulp after beating, paper mold 12 made of wire mesh or the like, measuring tank 13 for material pulp dispersed in water, feed pipe 14, feed valve 15, water inlet pipe 16 for diluting the dispersed pulp, inlet valve 17, drain pipe 18, and drain valve 19.

The paper forming process using the above apparatus will be described in the following.

First, water is supplied from the dilution water inlet pipe 16, and after the water level becomes higher than the paper mold 12, the pulp dispersion measured by the measuring tank 13 is supplied into the paper tank 11. After that, the pulp dispersion in the paper tank 11 is stirred by air or other stirring means 10.

After predetermined amounts of pulp dispersion and dilution water are supplied into the paper tank 11, and uniformly stirred, the pulp material in the paper tank 11 begins to slowly deposit on the paper mold 12. To finish this process in a short time, it is a common method to rapidly drain the water from the drain pipe 18. This method is called a draw-down method. At the time, a swirl is generated near the drain port of the paper tank 11, and the pulp rotated due to the swirl in the paper tank 11 is deposited on the paper mold 12. The pulp deposited on the paper mold 12 is taken out and dried, and then the central and peripheral portions thereof are cut off to obtain the diaphragm 3 shown in FIG. 6.

Besides the above method, there is a method like a traditional manual paper forming method as is employed in manufacturing Japanese paper. In this method, a net is put into the water tank and is slightly moved in all directions to regulate a thickness and orientation in a skillful manner, which is then taken out of the water. This is a so-called draw-up method.

The formed paper is dried to be a loudspeaker diaphragm as required. In this case, it is preferable to dry the loudspeaker diaphragm naturally. However, in the case of an industrial production, it is a common method to employ hot air, hot press, and flames individually or in combination in order to efficiently dry the diaphragm in a short time.

Although the diaphragm 3 using pulp is inexpensive and can be easily provided with desired sound characteristics by blending various kinds of pulp, it is difficult to control the variation of pulp deposition on the paper mold 12 in the paper forming process. Therefore, it is liable to cause variations in sound characteristics of a loudspeaker. On the other hand, as sound sources are recently becoming digital and higher in performance, it is increasingly required to develop a method of manufacturing loudspeaker diaphragms with highly accurate reproducibility.

The present invention is intended to address the above problems and to provide a manufacturing method and manufacturing apparatus of a diaphragm, a diaphragm manufactured by the method, and a loudspeaker using the diaphragm.

DISCLOSURE OF THE INVENTION

The loudspeaker diaphragm manufacturing apparatus of the present invention comprises a paper tank, a pulp dispersion reservoir tank connected to the paper tank, a stirring means provided in the paper tank, a water inlet unit connected to the paper tank, a drain unit disposed under the paper tank, and a paper mold installed at a bottom of the paper tank or in the drain unit, wherein a sectional area of the drain unit is larger than a plane area of the paper mold. Further, the drain unit may be provided with a water flow control plate in the draining direction of the paper mold. According to the manufacturing apparatus and method of the present invention, it is possible to perform mass-production of diaphragms with excellent reproducibility, which have very uniform internal composition and are intentionally varied in internal composition in accordance with the sound characteristics required.

BRIEF DESCRIPTION OF THE DRAWINGS

FIG. 3 (*b*) is a plan view of a water flow control slit plate of a paper forming machine in another preferred embodiment of the present invention.

DESCRIPTION OF THE PREFERRED EMBODIMENTS

Figure 1:
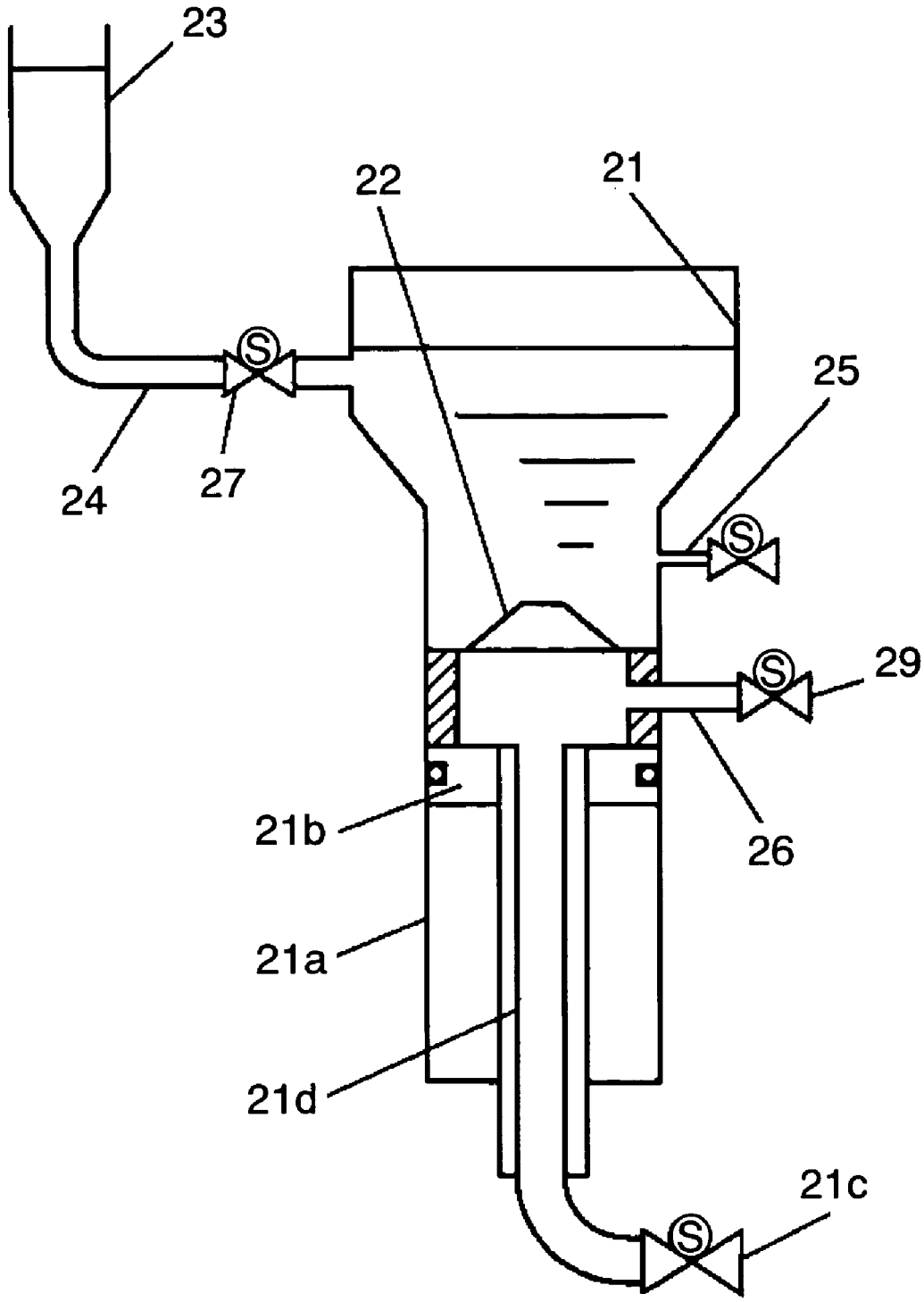
FIG. 1 is a schematic structural view of a paper forming machine used in the method of manufacturing loudspeaker diaphragm of the present invention.

The loudspeaker diaphragm manufacturing apparatus of the present invention will be described in the following with reference to FIG. 1 through FIG. 5. Incidentally, the same parts as those in the prior art are given same reference numerals, and further description is omitted.

Preferred Embodiment 1

In FIG. 1, a manufacturing apparatus of the present invention comprises paper tank 21 in which dispersed pulp after beating is deposited on a paper mold; paper mold 22 made of wire mesh or the like; measuring tank 23 for measuring material pulp dispersion dispersed in water; feed pipe 24; air passage 25 for stirring; water inlet pipe 26 for diluting the pulp dispersion; feed valve 27 for pulp dispersion; and dilution water valve 29.

Further, the manufacturing apparatus of the present invention comprises a cylindrical syringe 21*a* disposed at the bottom of the paper tank 21. The syringe 21*a* has a sectional area that is equivalent to or larger than a plane area of the paper mold 22. A plunger 21B is provided inside the syringe 21*a*, and the plunger 21*b* moves up and down while being in contact with the inner wall of the syringe 21*a*. The plunger 21*b* is moved up and down by hollow rod 21*d* provided with drain valve 21*c* at the lower end thereof.

The paper forming method used with the paper forming machine is described in the following.

First, with the plunger 21*b* kept at the upper limit, the pulp dispersion and the dilution water are respectively supplied from the measuring tank 23 and the dilution water pipe 26 into the paper tank 21, and after that, air is blown in through the air passage 25 to stir the pulp dispersion.

After stirring, the material pulp begins to gradually deposit on the paper mold 22 due to its weight. At this time, the plunger 21*b* corresponding to the bottom of the paper tank 21 is moved downward. Thus, only the water in the paper tank 21 passes through the mesh-like paper mold 22 and is sucked into the syringe 21*a* while the pulp is deposited on the paper mold 22, thereby forming a paper sheet. In this case, since the water passing through the mesh goes downward uniformly over the entire sectional area as the syringe 21*a* moves downward, no local turbulence of the water flow occurs.

This is because the sectional area of the syringe 21*a* is equivalent to or larger than the plane area of the paper mold. Consequently, the deposition of pulp is almost like that of a natural deposition, and it is possible to suppress the influence to the pulp orientation due to swirling of the drain or the like that occur in the conventional apparatus during paper forming. Further, since the syringe 21*a* is moved downward, the pulp depositing speed can be increased as compared with the speed of natural deposition, thus, paper sheet productivity can be improved. Furthermore, a pulp orientation in a vertical direction (that is, perpendicular to the diaphragm surface) can be regulated by controlling a lowering speed of the syringe 21*a*.

Further, according to the manufacturing method of the present invention, when diaphragms are manufactured by a plurality of paper forming machines, even where the paper forming machines have different sizes of paper tanks 21, the diaphragms obtained are extremely less in variation. That is, quality variations among the paper forming machines can be suppressed by controlling the lowering speed of the syringe 21*a* in accordance with the sizes of the paper tanks 21. In this way, the present invention is effective for stable supply of a large quantity of diaphragms.

Preferred Embodiment 2

Figure 2:
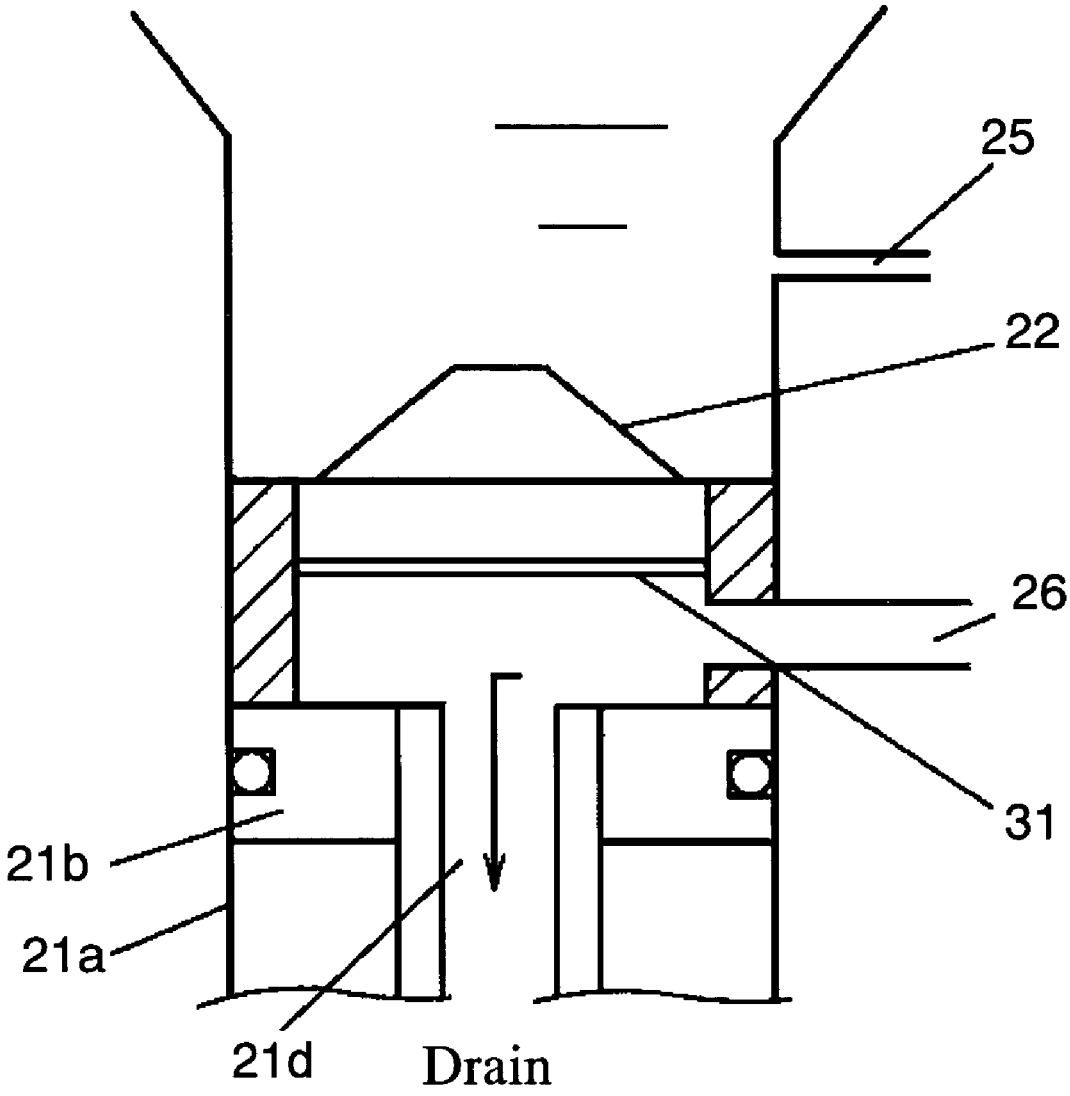
FIG. 2 is a schematic structural view of another paper forming machine of the present invention.

FIG. 2 shows a schematic structural view of a paper forming machine in the second preferred embodiment of the present invention. And, FIG. 3 (*a*) and FIG. 3 (*b*) show plan views of a water flow control slit plate which is an essential portion of the machine.

In FIG. 2, only the differences of the present preferred embodiment from the first preferred embodiment will be described.

Figure 3A:
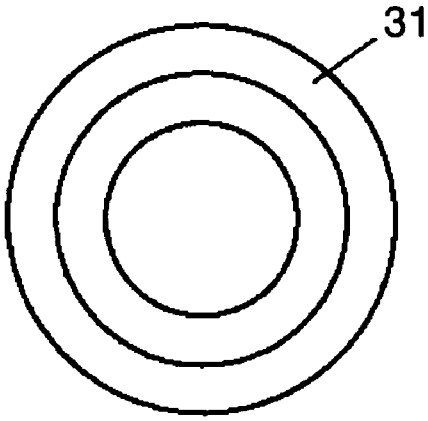
FIG. 3 (*a*) is a plan view of a water flow control slit plate of a paper forming machine in one preferred embodiment of the present invention.
Figure 3B:
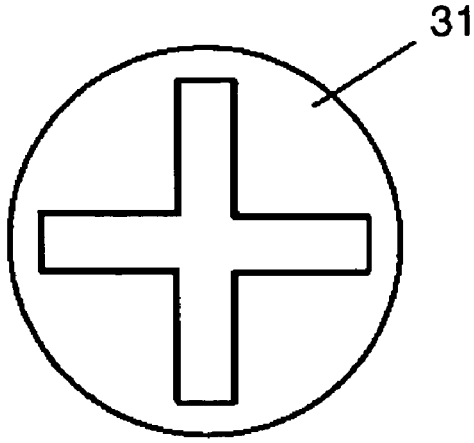

In the present preferred embodiment, water flow control slit plate 31 is disposed between plunger 21*b* and paper mold 22. In addition to the effect of the first preferred embodiment, in the present preferred embodiment, there is provided the water flow control slit plate 31, and the pulp orientation is intentionally controlled by positively adjusting the flow direction of the drain water. In this way, it is possible to control the sound characteristics of loudspeaker diaphragms. For example, the pulp orientation can be controlled by changing a water flow direction by a slit provided in the water flow control slit plate 31 in a shape such as a ring shape slit close to a periphery as shown in FIG. 3 (*a*), or a cross-shaped slit as shown in FIG. 3 (*b*). In this case, the slit shape is not limited to the above-described ring shape and cross shape, but various shapes such as concentric, oval, radial, star-like, and other shapes can also be used.

Since the water flow control by the above slit is performed at a position apart from the paper mold 22, a sectional thickness of the diaphragm does not partially change, and it is possible to obtain diaphragms which are uniform in thickness and partially controlled in the pulp orientation. Further, the diaphragm thickness can be partially and intentionally controlled. Thus, according to the present preferred embodiment, new effects can be obtained, in addition to the effects of the first preferred embodiment.

As described above, according to the diaphragm manufacturing method in the first preferred embodiment of the present invention, like in the draw-up method of a manual paper forming method for Japanese paper, the influence of the drain water on the pulp orientation can be suppressed. Further, it is possible to provide an industrial manufacturing method of loudspeaker diaphragms, which shows high productivity that can never be obtained by the manual paper forming method.

Moreover, when manufacturing diaphragms by using a plurality of paper forming machines, it is possible to realize a paper forming method which is not influenced by drain water flow which slightly differs in respective paper forming machines.

Also, according to the diaphragm manufacturing method in the second preferred embodiment of the present invention, by properly selecting various shapes of water flow control slit plate 31 above the syringe 21*a*, it is possible to intentionally create a drain flow for partially changing the pulp orientation and thickness. In this way, it becomes possible to mass-produce diaphragms with excellent reproducibility, which diaphragms have internal compositions that can never be provided by the conventional method. That is, the diaphragms having very uniform internal compositions, or the diaphragms intentionally changed in internal composition in accordance with required sound characteristics can be mass produced with excellent reproducibility.

"Internal composition" described here means the direction of pulp orientation, partial and intentional existence of difference in pulp densities, and kinds of pulp materials and their mixing ratio, and the like. Also, as a matter of course, addition of inorganic fiber other than pulp, powder or the like to the diaphragm is included for the purpose of improving the characteristics of the diaphragm.

Preferred Embodiment 3

Figure 4:
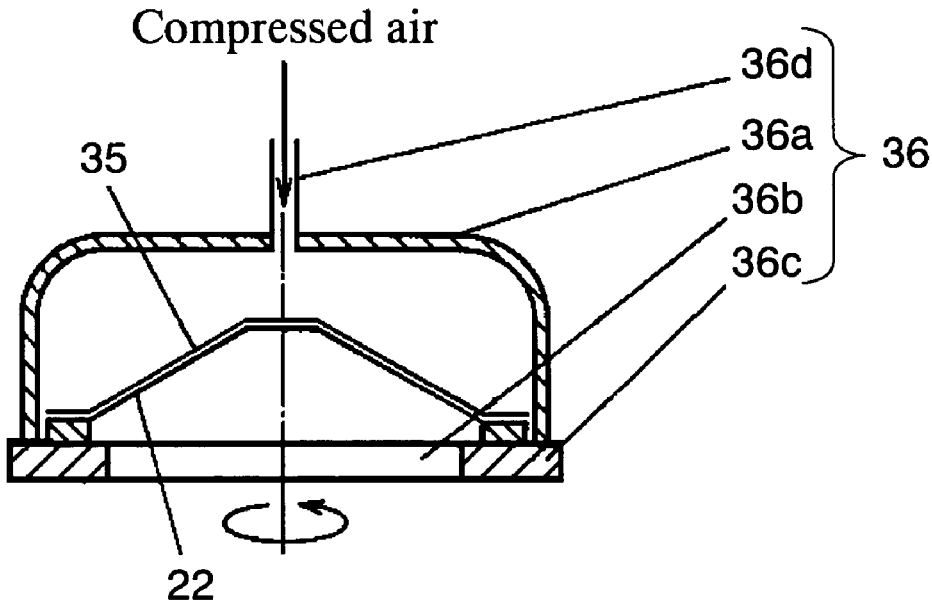
FIG. 4 is a structural sectional view of a drying apparatus for a diaphragm of the present invention.

FIG. 4 is a structural sectional view of a drying apparatus for the diaphragm of the present invention.

In FIG. 4, loudspeaker diaphragm paper 35 formed on paper mold 22 is the one taken out of the paper forming machine described in the preferred embodiment 1 or 2. The drying apparatus 36 in the present preferred embodiment comprises a cover 36*a* connected with compressed air pipe 36*d* disposed at a top center thereof, and a rotating disk 36*c* with opening 36*b*, on which the paper mold 22 is disposed.

The operation of the drying apparatus 36 is described in the following.

The paper loudspeaker diaphragm 35 is disposed on the rotating disk 36*c* together with the paper mold 22, which is then rotated at a high speed with the cover 36*a* to separate water by centrifugal forces for drying. During the rotation, in order to prevent the peripheral portion of the diaphragm 35 from floating due to high-speed rotation and being deformed during drying, the diaphragm 35 is pressed to the paper mold 22 by compressed air to maintain its shape. If no pressure is applied by compressed air, the loudspeaker diaphragm may fly off due to high-speed rotation, in the worst case.

The opening 36*b* of the rotating disk 36*c* is provided to prevent the decreasing of the effect to keep the diaphragm 35 on the paper mold 22 when the compressed air passes through the spaces between pulp of the loudspeaker diaphragm 35 and charged under the diaphragm 35.

With the drying apparatus in the present preferred embodiment, it has been confirmed that the loudspeaker diaphragm is reliably dried when the rotating speed is 500–1800 rpm and the compressed air pressure is 0.2–0.8 MPa. To improve the productivity, taking into account a bearing accuracy and dynamic balance at high-speed rotation and also an economy of compressed air used, it is preferable to set the rotating speed to 1000–1500 rpm and the compressed air pressure to 0.3–0.5 MPa.

In the present preferred embodiment, a diaphragm drying method by centrifugal dehydration has been described, but it is also preferable to use conventional hot air drying after drying by centrifugal dehydration. According to the present preferred embodiment, even when a conventional drying method using hot air or the like is employed, since most of the water in the diaphragm has been already removed by centrifugal dehydration, it is unnecessary to heat the diaphragm excessively and pulp deterioration of the diaphragm does not occur.

In other words, in the present preferred embodiment, unlike the conventional loudspeaker diaphragm, pulp deterioration of the diaphragm does not occur due to heating, and the drying time can be greatly shortened as compared with the conventional drying method by heating. As a result, a heat source used can be minimized, enabling considerable reduction of energy consumption.

Also, in a conventional method, the operation requires considerable work using a large dryer, but in the drying method of the present preferred embodiment, the drying process can be incorporated in an automated production line, greatly contributing to the improvement of productivity.

In the present preferred embodiment, it is described that a diaphragm formed in the preferred embodiment 1 or 2 is used, but it is also possible to apply the drying method of the present preferred embodiment to a diaphragm obtained by the conventional paper forming method, and even in that case, similar results can be obtained.

Further, besides a loudspeaker diaphragm, it is possible to apply the drying method based on centrifugal dehydration of the present preferred embodiment to a paper container previously formed by another paper forming method, and it may bring about considerable effects for the reduction of energy consumption in drying.

Preferred Embodiment 4

Figure 5:
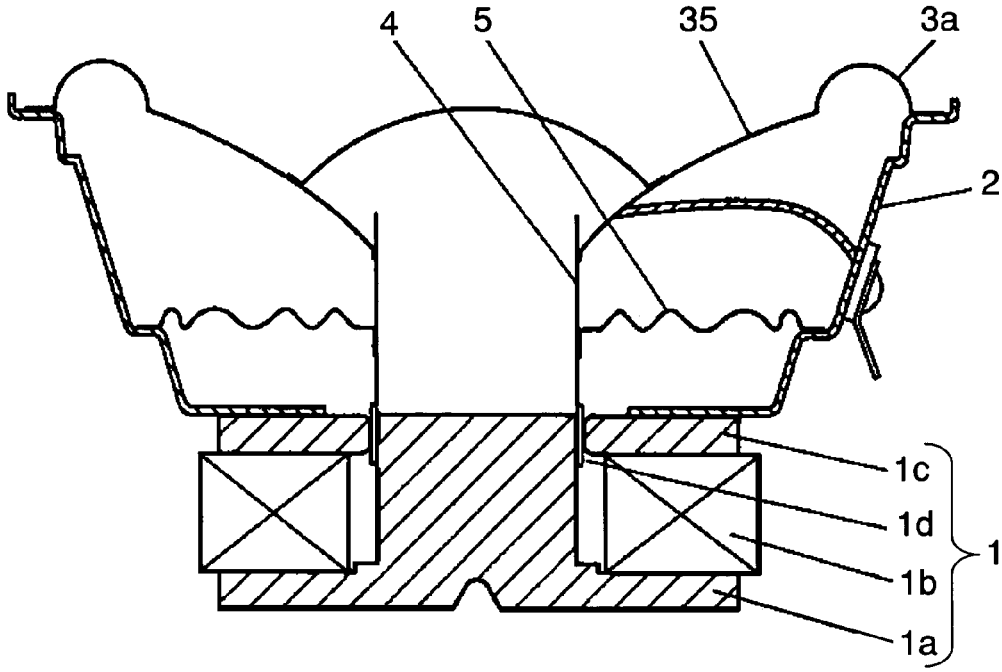
FIG. 5 is a sectional view of a loudspeaker in one preferred embodiment of the present invention.
Figure 6:
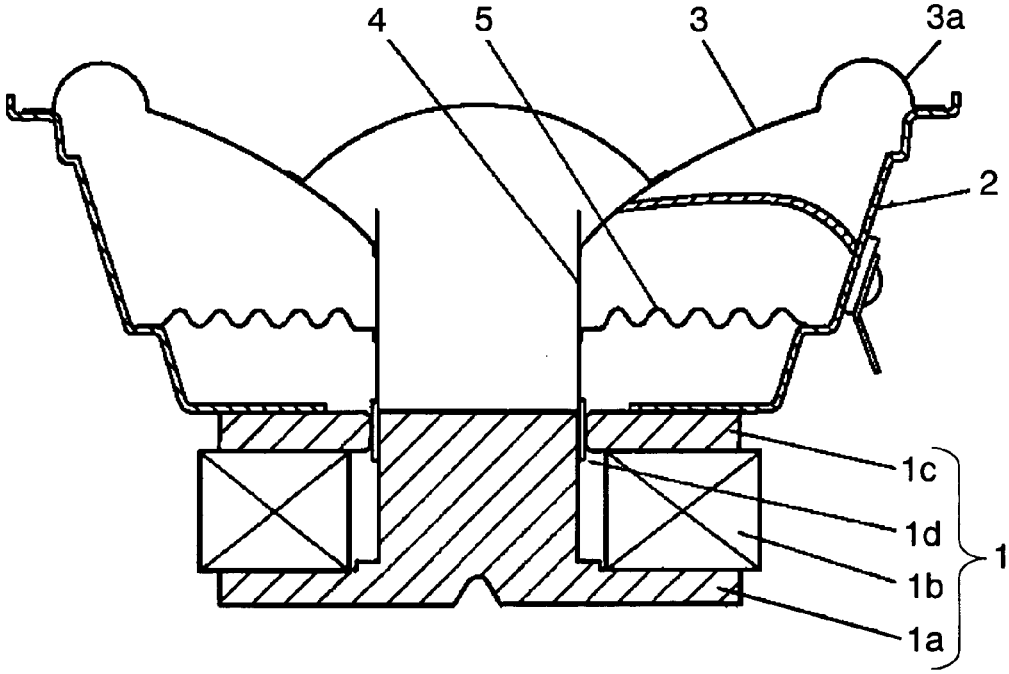
FIG. 6 is a sectional view of a conventional loudspeaker.
Figure 7:
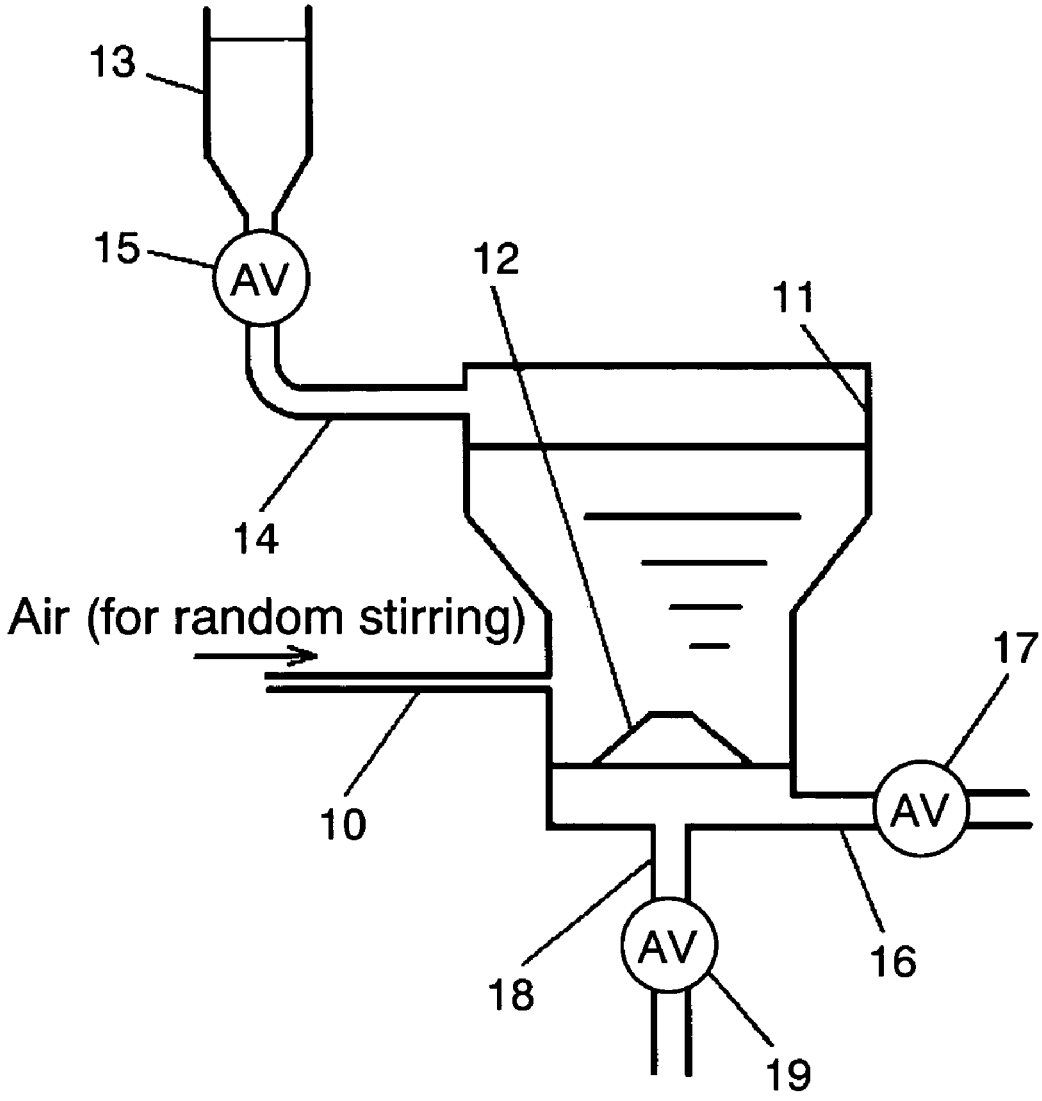
FIG. 7 is a schematic structural view of a conventional paper forming machine for a loudspeaker diaphragm.

A loudspeaker in one preferred embodiment of the present invention will be described with reference to FIG. 5.

The point of difference of the loudspeaker in the present preferred embodiment from the prior art is a diaphragm, and diaphragm 35 obtained in the first preferred embodiment through the third preferred embodiment is used to form the loudspeaker.

In the present preferred embodiment, a diaphragm having very uniform internal composition or a diaphragm with internal composition intentionally changed in accordance with required sound characteristics, as described in the first or second preferred embodiment, is used as the diaphragm.

Such internal composition and compositional distribution in the diaphragm can be confirmed through a visual observation of surfaces or sections and by a physical measurement of gas permeability and light transmittance. The visual observation of surfaces or sections can be observed by an optical microscope, an electron microscope, or a surface roughness measuring device.

According to the present preferred embodiment, it is possible to perform the mass-production of loudspeakers having stable sound characteristics by employing diaphragms with uniform quality or diaphragms with internal composition intentionally controlled in accordance with the purposes.

INDUSTRIAL APPLICABILITY

As described above, the manufacturing method of loudspeaker diaphragms of the present invention provides the loudspeaker diaphragms with excellent reproducibility and stable quality, while maintaining high productivity. Also, mass-produced loudspeakers using the diaphragms has very uniform sound characteristics.

The invention claimed is:

1. An apparatus for manufacturing a loudspeaker diaphragm, comprising:

a paper tank;

a pulp dispersion reservoir tank connected to said paper tank;

a stirring device provided in said paper tank;

a water inlet unit connected to said paper tank;

a drain unit disposed under said paper tank; and a paper mold disposed at a bottom of said paper tank or in said drain unit;

wherein a sectional area of said drain unit is larger than a plane area of said paper mold;

wherein said drain unit comprises a syringe and a plunger disposed therein; and wherein a water flow control plate is provided in said drain unit in a draining direction of said paper mold.

2. The apparatus of claim 1, wherein said water flow control plate is provided with a slit having at least one of a ring-shape, a cross-shape, a concentric-shape, an oval-shape, a radial-shape, and a star-shape.

3. The apparatus of claim 1, wherein said stirring device comprises an air inlet.

4. The apparatus of claim 1, wherein said pulp dispersion reservoir tank constitutes a measuring tank.

5. The apparatus of claim 1, wherein said drain unit comprises a syringe and a plunger disposed therein.

6. The apparatus of claim 1, further comprising a separate drying apparatus, said drying apparatus comprising:

a rotating disk on which said paper mold is disposed; and a cover provided with a compressed air inlet port.

7. An apparatus for manufacturing a loudspeaker diaphragm, comprising:

a paper tank;

a pulp dispersion reservoir tank connected to said paper tank;

a stirring device provided in said paper tank;

a water inlet unit connected to said paper tank;

a drain unit disposed under said paper tank; and a paper mold disposed at a bottom of said paper tank or in said drain unit;

wherein a sectional area of said drain unit is larger than a plane area of said paper mold;

wherein said drain unit comprises a syringe and a plunger disposed therein;

wherein a separate drying apparatus is provided, said drying apparatus comprising a rotating disk on which said paper mold is disposed, and a cover provided with a compressed air inlet port.

8. The apparatus of claim 7, wherein said rotating disk has an opening.

9. The apparatus of claim 7, wherein said stirring device comprises an air inlet.

10. The apparatus of claim 7, wherein said pulp dispersion reservoir tank comprises a measuring tank.

11. A method of manufacturing a loudspeaker diaphragm, comprising:

introducing pulp dispersion into a paper tank;

stirring said pulp dispersion; and draining water to deposit pulp on a paper mold;

wherein a drain unit having a sectional area larger than a plane area of said paper mold is employed in said draining of the water; and wherein said drain unit comprises a syringe and a plunger disposed therein.

12. The method of claim 11, wherein said stirring is performed before said draining.

13. The method of claim 11, wherein said draining is performed via a water flow control plate disposed at a drain side of said paper mold.

14. The method of claim 13, wherein said water flow control plate is provided with a slit having at least one of a ring-shape, a cross-shape, a concentric-shape, an oval-shape, a radial-shape, and a star-shape.

15. The method of claim 11, further comprising drying the pulp deposited on said paper mold, wherein said drying comprises dehydration in which the pulp deposited on said paper mold is rotated together with said paper mold to remove water.

16. The method of claim 15, wherein said pulp deposited on said paper mold is kept with compressed air during said rotation.

17. The method of claim 15, wherein hot air drying is additionally used in said drying.

18. The method of claim 12, wherein said draining is performed via a water flow control plate disposed at a drain side of said paper mold.

19. The method of claim 12, further comprising drying of the pulp deposited on said paper mold, wherein said drying comprises a step of dehydration in which pulp deposited on said paper mold is rotated together with said paper mold to remove water.

20. A diaphragm manufactured by the method of claim 11, said diaphragm being controlled of internal compositions, including a direction of pulp orientation, existence of partial and intentional differences in pulp density, kinds of pulp materials and their blending ratios, and addition of inorganic fiber other than the pulp and powder.

21. A loudspeaker using the diaphragm of claim 20.

22. A diaphragm manufactured by the method of claim 12, said diaphragm being controlled of internal compositions, including a direction of pulp orientation, existence of partial and intentional differences in pulp density, kinds of pulp materials and their blending ratios, and addition of inorganic fiber other than the pulp and powder.

23. A diaphragm manufactured by the method of claim 13, said diaphragm being controlled of internal compositions, including a direction of pulp orientation, existence of partial and intentional differences in pulp density, kinds of pulp materials and their blending ratios, and addition of inorganic fiber other than the pulp and powder.

24. A diaphragm manufactured by the method of claim 14, said diaphragm being controlled of internal compositions, including a direction of pulp orientation, existence of partial and intentional differences in pulp density, kinds of pulp materials and their blending ratios, and addition of inorganic fiber other than the pulp and powder.

25. A diaphragm manufactured by the method of claim 15, said diaphragm being controlled of internal compositions, including a direction of pulp orientation, existence of partial and intentional differences in pulp density, kinds of pulp materials and their blending ratios, and addition of inorganic fiber other than the pulp and powder.

26. A diaphragm manufactured by the method of claim 16, said diaphragm being controlled of internal compositions, including a direction of pulp orientation, existence of partial and intentional differences in pulp density, kinds of pulp materials and their blending ratios, and addition of inorganic fiber other than the pulp and powder.

27. A diaphragm manufactured by the method of claim 17, said diaphragm being controlled of internal compositions, including a direction of pulp orientation, existence of partial and intentional differences in pulp density, kinds of pulp materials and their blending ratios, and addition of inorganic fiber other than the pulp and powder.

* * * * *

UNITED STATES PATENT AND TRADEMARK OFFICE

CERTIFICATE OF CORRECTION

PATENT NO. : 7,118,649 B2
APPLICATION NO. : 10/471014
DATED : October 10, 2006
INVENTOR(S) : Yukinori Morohoshi et al.

It is certified that error appears in the above-identified patent and that said Letters Patent is hereby corrected as shown below:

ON THE TITLE PAGE

In the abstract, line 2, please replace "comprises: a paper tank," with --comprises a paper tank,--.

In the abstract, line 3, please replace "a stirring means" with --a stirring device--.

Signed and Sealed this

Sixth Day of February, 2007

JON W. DUDAS
*Director of the United States Patent and Trademark Office*